United States Patent [19]

DiMenichi

[11] Patent Number: 4,934,592

[45] Date of Patent: Jun. 19, 1990

[54] OUTGOING MAIL RECEPTACLE FOR RURAL MAILBOX

[76] Inventor: Dante S. DiMenichi, 1735 Butztown Rd., Bethlehem, Pa. 18017

[21] Appl. No.: 314,035

[22] Filed: Feb. 23, 1989

[51] Int. Cl.[5] ..... B65D 91/00

[52] U.S. Cl. ..... 232/17

[58] Field of Search ..... 232/17, 19, 20, 21, 232/34, 27, 38

[56] References Cited

U.S. PATENT DOCUMENTS

| | | | |
|---|---|---|---|
| 908,543 | 1/1909 | Brown | 232/34 |
| 1,982,923 | 12/1934 | Nelson | 232/17 X |
| 2,437,053 | 3/1948 | Swanson | 232/17 |
| 4,600,143 | 7/1986 | Harlow et al. | 232/17 |
| 4,753,385 | 6/1988 | Phipps et al. | 232/17 |

*Primary Examiner*—Robert W. Gibson, Jr.

*Attorney, Agent, or Firm*—William D. Stokes

[57] ABSTRACT

An outgoing mail receptacle for a rural mailbox wherein a container is positioned within the mailbox and supported by a leaf spring having one end connected to the mailbox door so that when the mailbox door is opened, the container is moved outwardly from the mailbox to expose the outgoing mail in the container.

6 Claims, 1 Drawing Sheet

FIG. 1
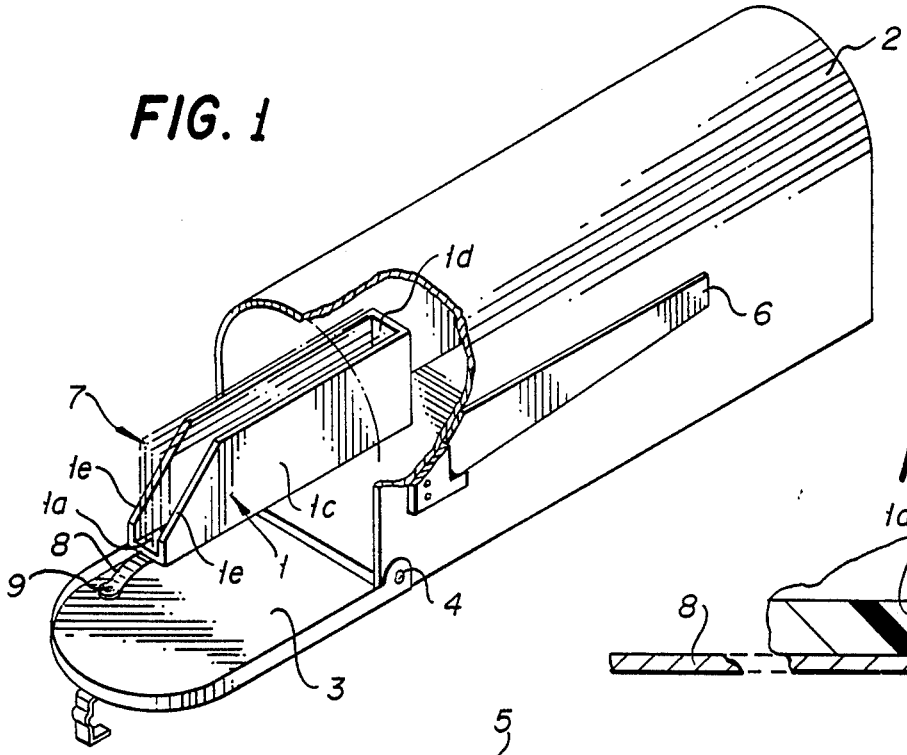
FIG. 5
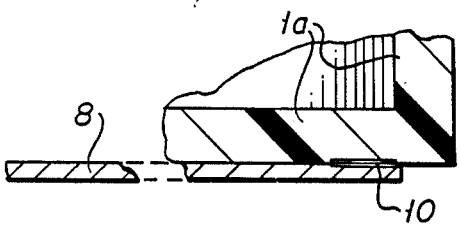
FIG. 3
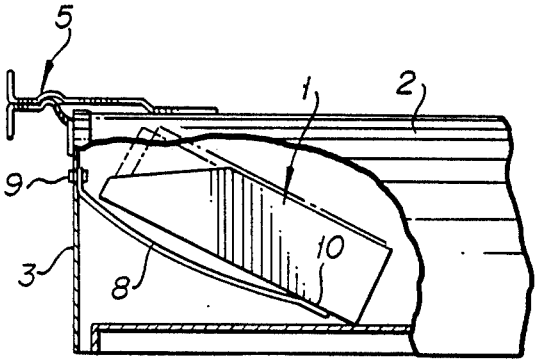
FIG. 2
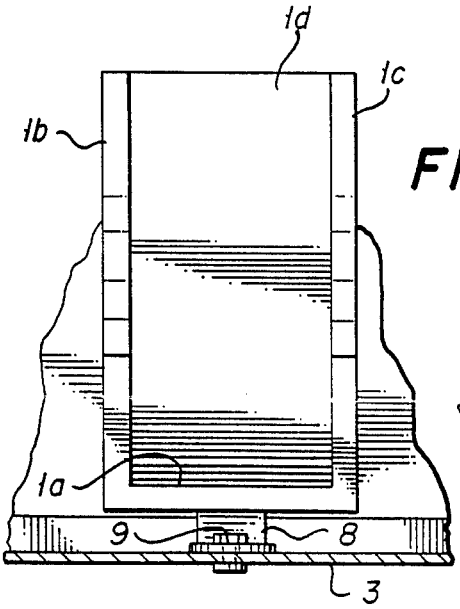
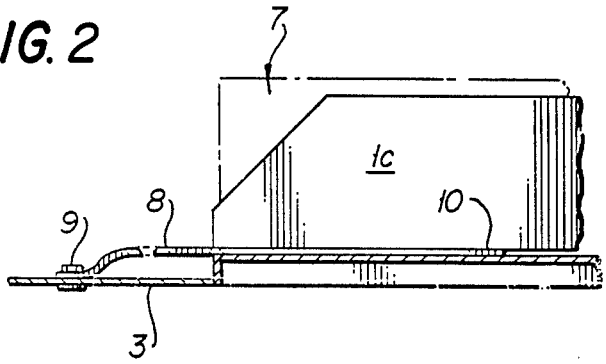
FIG. 4

OUTGOING MAIL RECEPTACLE FOR RURAL MAILBOX

BACKGROUND OF THE INVENTION

Conventional rural mailboxes include a door pivotally attached to one end of the box, a mechanical latching device to hold the door in the closed position, and a signal device, such as a flag pivotally connected to the side of the box to indicate the presence or absence of mail in the box. In use, the postal carrier delivers incoming mail to the box and collects any outgoing mail placed in the box by the resident or owner of the mailbox. Such an arrangement can be time-consuming for the postal carrier who must first remove the outgoing mail from the box before placing the mail being delivered into the box.

In an effort to segregate the outgoing mail from the incoming mail in a rural type mailbox, U.S. Pat. No. 916,766 discloses a letter box having a receptacle or shelf operatively connected to the door of the box in such a manner that the receptacle is drawn out of the box when the door is opened, to thereby expose the mail which is to be collected. While the mailbox disclosed in the above noted patent is satisfactory for its intended purpose, the receptacle is built into the mailbox as an original accessory requiring brackets, secured to the side walls of the box, upon which the receptacle or shelf is slidably mounted, and links are pivotally connected between the mailbox door and bottom of the receptacle.

In order to provide an improved rural mailbox having provision for segregating the outgoing mail from the incoming mail, the receptacle of the present invention has been devised which cannot only be provided as an original accessory for new mailboxes, but also as an accessory easily installed in existing mailboxes.

The mail receptacle of the present invention comprises, essentially, a receptacle, adapted to receive outgoing mail, connected to the door of a conventional rural mailbox by a leaf spring having one end secured to the inside face of the mailbox door, and the opposite end connected to the bottom wall of the receptacle, whereby the receptacle is supported by the leaf spring in a cantilevered manner, to thereby provide a floating receptacle so that when the mailbox door is opened, the receptacle is pulled forwardly out of the box to expose the mail in the receptacle for immediate pick up by the postal carrier.

BRIEF DESCRIPTION OF THE DRAWING

FIG. 1 is a fragmentary, perspective view of the outgoing mail receptacle of the present invention connected to a conventional rural mailbox;

FIG. 2 is an enlarged, fragmentary front end elevational view of the receptacle as shown in FIG. 1;

FIG. 3 is a fragmentary, sectional, side elevational view of the receptacle positioned within the mailbox when the door is closed;

FIG. 4 is a fragmentary, sectional side elevational view showing the orientation of the receptacle when the mailbox door is opened; and FIG. 5 is a fragmentary, sectional side elevational view of the end of the leaf spring connected to the bottom wall of the receptacle.

DESCRIPTION OF THE INVENTION

Referring to the drawings and more particularly to FIG. 1, the outgoing mail receptacle 1 of the present invention is adapted to be mounted within a conventional rural mailbox 2 having a door 3 pivotally attached as at 4 to the open end portion of the box. A mechanical latching device 5 is provided to hold the door in the closed position, as shown in FIG. 3, and a signal device 6 is pivotally connected to the side of the box to indicate the presence or absence of mail in the box.

The details of the construction of the outgoing mail receptacle 1 are shown in FIGS. 1, 2 and 3 wherein it will be seen that the receptacle consists of an elongated container having a bottom wall 1*a*, side walls 1*b*, 1*c* and an end wall 1*d*. The top of the container is open as is the end opposite from the end wall 1*d*, and the portions of the side walls 1*b*, 1*c* are cut away as at 1*e* to provide an open area to facilitate the placement of letters 7 into the receptacle and the removal therefrom.

The receptacle 1 is dimensioned to have a width and a heighth somewhat smaller than the corresponding dimensions of the box 2, and is positioned in the box 2 in proximity to a side wall of the box, to thereby provide an accessible area in the remaining portion of the box for the reception of incoming mail.

The receptacle 1 is secured to the box 2 by a leaf spring 8 having one end secured to the inside face of the door 3 as at 9, and the opposite end connected to the bottom wall 1*a* of the container as at 10 in proximity to the end wall 1*d*, so that when the mailbox door is opened the receptacle 1 is pulled forwardly out of the box 2, as shown in FIG. 1, to expose the mail 7 in the receptacle for immediate pick up by the postal carrier. While the leaf spring 8 is fixedly attached to the receptacle at 10 by rivets or by welding, the attachment 9 of the leaf spring 8 to the door 3 is accomplished by removable fasteners, such as, sheet metal screws or nut and bolt assemblies. By this construction and arrangement, the receptacle 1 cannot only be provided as an original accessory for new mailboxes, but also as an accessory installed in existing mailboxes.

As will be seen in FIG. 3, the receptacle 1 is supported by the leaf spring in a cantilevered manner to thereby provide a floating receptacle which is oriented in an inclined position within the mailbox 2 when the door 3 is closed. By supporting the receptacle 1 on the spring 8 there is minimal sliding contact between the bottom walls of the receptacle and mailbox during the opening and closing of the door 3, whereby the receptacle is designed for long and continued use.

It is to be understood that the form of the invention herewith shown and described is to be taken as a preferred example of the same, and that various changes in the shape, size and arrangement of parts may be resorted to, without departing from the spirit of the invention or scope of the subjoined claims.

What is claimed is:

1. An outgoing mail receptacle for a rural mailbox of the type including a door pivotally connected to one end of the mailbox comprising, a container for receiving outgoing mail, said container being positioned in the mailbox in proximity to a side wall thereof, the width of the container being less than the width of the mailbox, to thereby provide an accessible area in the remaining portion of the box for the reception of incoming mail, flexible spring means not connected with the mailbox for supporting the container in the mailbox (,and) including means for fastening (one end of the) said container support means to the container and (the other end of the support means to) the mailbox door, whereby when the mail box door is opened the container is pulled forwardly out of the box to expose the mail in the container for immediate pick-up by a postal carrier.

2. An outgoing mail receptacle for a rural mailbox according to claim 1, wherein the container is elongated and has a bottom wall, a pair of side walls and an end wall, said container being open on the top and on the end opposite from the end wall, to thereby provide an open area adjacent the mailbox door to facilitate the placement of letters into the container and the removal therefrom.

3. An outgoing mail receptacle for a rural mailbox according to claim 2, wherein the means for supporting the container in the mailbox comprises a leaf spring.

4. An outgoing mail receptacle for a rural mailbox according to claim 3, wherein one end of the leaf spring is fixedly attached to the bottom wall of the container in proximity to the end wall thereof, and the opposite end of the leaf spring is attached to the interior face of the mailbox door.

5. An outgoing mail receptacle for a rural mailbox according to claim 4, wherein the opposite end of the leaf spring is attached to the interior face of the mailbox door by removable fastener means, whereby the outgoing mail receptacle can be installed in existing rural mailboxes.

6. An outgoing mail receptacle for a rural mailbox of the type including a door pivotally connected to one end of the mailbox, a container for receiving outgoing mail, said container being positioned within said mailbox, a leaf spring supporting said container, one end of said leaf spring being connected to said container and the opposite end of said leaf spring being connected to the mailbox door, whereby when the mailbox door is opened, the container is pulled forwardly out of the box to expose the mail in the container for pick up by the postal carrier.

* * * * *